United States Patent [19]

Kuenzel et al.

[11] Patent Number: 4,774,014

[45] Date of Patent: Sep. 27, 1988

[54] DETERGENT SUPPLY PACK AND PROCESS FOR PRODUCTION

[75] Inventors: Werner Kuenzel, Langenfeld; Theodor Altenschoepfer, Duesseldorf; Peter Jeschke, Neuss; Jochen Jacobs, Wuppertal; Kerstin Ochs, Langenfeld, all of Fed. Rep. of Germany

[73] Assignee: Henkel Kommanditgesellschaft auf Aktien, Duesseldorf, Fed. Rep. of Germany

[21] Appl. No.: 49,195

[22] Filed: May 12, 1987

[30] Foreign Application Priority Data

May 14, 1986 [DE] Fed. Rep. of Germany ..... 3616194

[51] Int. Cl.[4] ..... C11D 17/00; C11D 11/00; C11D 13/16

[52] U.S. Cl. ..... 252/90; 252/93; 252/99; 252/174

[58] Field of Search ..... 252/90, 93, 99, 174; 206/607, 610, 804; 229/52 B; 220/94 A

[56] References Cited

U.S. PATENT DOCUMENTS

| | | | |
|---|---|---|---|
| 659,238 | 10/1900 | Killinger | 229/52 B |
| 2,031,853 | 2/1936 | Potts | 226/93 |
| 2,679,349 | 5/1954 | Mullinix | 229/40 |
| 3,825,049 | 7/1974 | Swett | 150/0.5 |
| 4,179,040 | 12/1979 | Bateman | 220/410 |
| 4,216,763 | 8/1980 | Miklas | 126/275 R |
| 4,343,428 | 8/1982 | Persson | 229/31 R |
| 4,426,362 | 1/1984 | Copeland et al. | 422/263 |
| 4,549,657 | 10/1985 | Martin | 206/610 |
| 4,569,780 | 2/1986 | Fernholz | 252/90 |
| 4,569,781 | 2/1986 | Fernholz et al. | 252/92 |
| 4,572,377 | 2/1986 | Beckett | 206/610 |
| 4,681,914 | 7/1987 | Olson | 252/91 |

FOREIGN PATENT DOCUMENTS

| | | |
|---|---|---|
| 0208776 | 4/1960 | Austria . |
| WO801160 | 6/1980 | PCT Int'l Appl. . |

*Primary Examiner*—Paul Lieberman
*Assistant Examiner*—Kathleen Markowski
*Attorney, Agent, or Firm*—Ernest G. Szoke; Henry E. Millson, Jr.; Mark A. Greenfield

[57] ABSTRACT

A detergent supply pack for supplying a shaped detergent solid to a dishwashing apparatus comprising a container for the detergent solid and a shaped detergent solid cast-molded therein, said container simultaneously functioning as a mold for the cast-molded detergent, as a container for the detergent solid during storage and shipping, and as improved handling means for handling the detergent for storing and shipping and for introducing the detergent into the dishwashing apparatus.

24 Claims, 5 Drawing Sheets

DETERGENT SUPPLY PACK AND PROCESS FOR PRODUCTION

BACKGROUND OF THE INVENTION

1. Field of the Invention

This invention relates to a detergent supply pack for use with institutional dishwashing machines. The invention also relates to a process for the production of the supply pack and, more especially, to a process for the production of a supply pack for a solid detergent block for use with institutional dishwashing machines.

2. Statement of Related Art

Hitherto, various products and packs have been developed to provide institutional dishwashing machines with a supply of detergents from which measured amounts of detergent are dispensed to the dishwashing machine. These products include detergents in powder form, in liquid form, and in paste form which are generally packed in dispensers specifically corresponding to the particular product type and which are automatically dispensed on demand. The necessary dispensers are expensive, especially in regard to production and maintenance. More recently, block-form detergents for domestic and institutional dishwashing machines have been developed, which have the advantage of being dimensionally stable. These detergents are dissolved by simply spraying with water, and then are delivered to the wash liquor in solution. Since institutional detergents often have a high caustic alkali content, contact with the skin should be avoided; block-form detergents are much safer to handle and thus also superior in this regard.

U.S. Pat. Nos. 4,569,780 and 4,569,781 (and corresponding published European patent application No. 3,769) describe a detergent container suitable for use in dishwashing machines adapted for molding detergents in block form. A molten detergent is poured into the container and allowed to solidify; the detergent is subsequently dissolved from the container on contact with a stream of aqueous liquid from the dishwasher. The advantage of a block-form detergent of this type is that, with proper handling, contact with the skin is virtually eliminated.

Owing to the shape thereof, however, the container described in these patents requires an unreasonably high consumption of flushing water to remove residual detergent in the container. The incomplete dissolution of detergent residues in the container is frequently so pronounced that a "container empty" signal is triggered, although substantial residues of product are clearly still present. This situation is unacceptable both for economic reasons and for safety reasons. Detergent residues in the container are a potential danger source to the user when the supposedly empty container is being replaced by a completely full container. Further, since the container described in these patents is formed from a stable, thick-walled plastic material and is intended to be thrown away when empty, its use is environmentally unsound.

U.S. Pat. No. 4,426,362 describes a dishwasher distributor for a solid block-form molded detergent. The block-form detergent of this reference is positioned with its casting mold in the receiving means of the distributor so that the casting mold surrounds the detergent block during the flushing-out process and touches it on all sides except for one free face. Once again, contactless handling of the detergent is provided, but once again, the consumption of water is high and complete emptying is not guaranteed.

SUMMARY OF THE INVENTION

The present invention provides a detergent supply pack for a cast detergent block which permits convenient filling and refilling of the detergent distributor of institutional dishwashing machines and which ensures that the detergent block, which is desirably a fused block, is introducible into the distributing apparatus without direct contact with the skin of the supplier. More particularly, the invention provides a detergent supply pack adapted for ready dissolution and delivery to the wash section, so that water consumption is not appreciably higher than in the case of powder-form or paste-form detergents, even towards the end of the block. The invention also provides a process for packing block-form detergents produced in plastic to molten form without employing conventional coating molds.

DETAILED DESCRIPTION OF THE INVENTION

Figure 1:
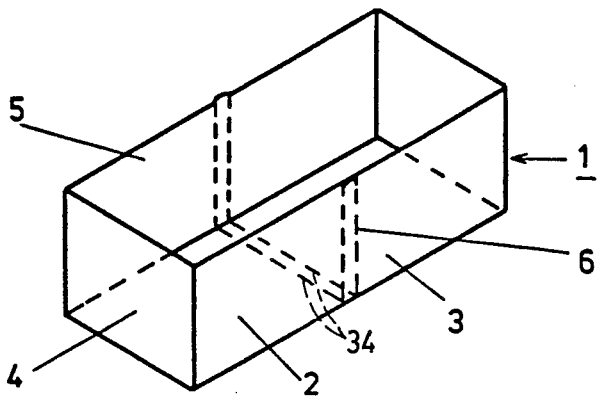
FIG. 1 is a perspective view of a supply pack according to the invention including container means comprising an erected folding box.

Other than in the operating examples, or where otherwise indicated, all numbers expressing quantities of ingredients or reaction conditions used herein are to be understood as modified in all instances by the term "about ".

The invention provides a supply pack for a solidified, shaped detergent, especially a fused detergent block, which is readily dissolvable on contact with flushing water. The supply pack functions as a retail pack, and also as a casting mold for the production of the detergent block from a fluid detergent material which is solidified in the pack mold and further functions as a handling aid for the introduction of an unpacked detergent block into the detergent distributor of the dishwashing machine without contact with the skin. Thus, both time and money are saved in the production of the shaped detergent, while distribution of the detergent within the washer is facilitated.

The supply pack of the invention thus comprises a container which conforms to the shape of the detergent solid and which both functions as a mold for receiving detergent in a moldable physical state and as a container for the solidified detergent. The container includes dispensing means for dispensing the solid shaped detergent from the supply pack to the distributor portion of the dishwashing machine, such as a single open or openable side, which additionally functions as an inlet port for introducing moldable detergent into the container; the dispensing means essentially permit the user to avoid skin contact with the detergent. Preferably, the container further includes release means for promoting disengagement of the solid detergent from the supply pack for dispensing to the distributor portion of the machine; suitable release means include tear- or fold-strips which promote easy opening of the container to facilitate ejection of the solid detergent shape into the distributor portion of the dishwashing or other washing machine. Again, the release means are essentially adapted to permit the user to avoid direct skin contact with the detergent. Desirably, the supply pack further includes protective means for avoiding detergent splashback on loading the distributor of the dishwasher or on filling the mold with molten or plastic detergent; useful protective means include rimming means for rimming the container. In a further important aspect of the invention, the container includes gripping means for facilitating handling of the supply pack and especially for handling during loading of the dishwasher distributor; exemplary gripping means include tabs or ridges integrally formed with the container elements, or separately formed and secured to the appropriate part of the container by suitable fastening means, such as gluing.

The container is shaped to the desired contours of the solid detergent to mold the detergent accordingly. The detergent is shapeable into fanciful contours, or, most usually, according to the requirements of the distributor means of the dishwashing machine. From a handling point of view, rectangular or square forms are generally more useful than round or cylindrical blocks. The container comprises a variety of forms and materials, with the advantage that the materials need not resist disintegration in the environment of the dishwashing machine as according to the known containers discussed supra, as the detergent is dispensed from these containers into the distributor. The materials employed must, however, withstand the detergent molding temperatures, usually from about 50° C. to 70° C. for molten materials or somewhat lower, for example about 10° C. to 15° C. lower, for extruded or kneaded pliable and moldable detergent material. Particularly useful materials contemplated are cardboard or other heavy paper or cellulosic, particularly including reinforcing means for strengthening the mold such as cardboard which is plastic-impregnated or plastic-laminated. Additional, light-gauge plastics such as polyethylene or composite films, or deep-drawn plastics such as polyvinyl chloride, polypropylene, or polyethylene are particularly useful and, again, in the application of the invention, need not be water-impermeable as in prior art applications. Containers for shaped detergents having cuboid or rectangular form are conveniently formed as a plurality of sides defining a box-type structure, while containers for irregular shapes are conveniently formed as at least semi-rigid plastic molds; for these latter molds, a shape facilitating dispensing of the detergent from the container is desirable.

In general, an individual detergent block comprises a dosage unit of detergent. Preferably it is delivered to the washing section of the dishwashing machine from the dispenser by flushing the block with water. Usually, the quantity of the detergent in the block is greater than the detergent demand for a single dishwashing cycle. Detergent blocks weighing from 0.5 to 4 kg are generally preferred for ease of handling.

For introduction into the detergent distributor of the dishwashing machine, the detergent block is dispensed from the supply pack directly into the distributor. In order inter alia to protect the user from direct skin contact with the block which contains caustic constituents, the supply pack is opened on at least one side. Thus economy, outlay on packing material and convenience of handling are optimized according to the invention since the detergent block is delivered directly from its pack, which also functions as the casting mold, into the dishwasher distributor where it is eventually dissolved by exposure to water and delivered to the wash cycle. Sliding the block from the supply pack directly into the dispenser affords the user extensive protection against skin contact with the detergent during refilling. The presentation of the detergent to the dishwashing machine as a detergent block removed from its packaging enables the detergent to be dispensed by a distributor of very simple design. In this connection, a plurality of detergent blocks may be disposed horizontally or vertically for sequential dispensing as a supply in a sleeve, for example a "lattice" sleeve, and refilled from above. The detergent is thus conveniently dispensed in predetermined amounts by introduction of a corresponding number of selected detergent blocks, variable according to the size of the distributor, into the distributor. The dishwashing machine thus need not be equipped with means for complicated measuring, distributing, or metering the detergent. For delivery to the wash cycle, the detergent blocks are conveniently sprayed with water and dissolved, and the dissolved detergent fed through a conduit to the wash area, typically by a gravity feed system. To minimize the consumption of water, the detergent block is exposed as much as possible to the action of the dissolving water which has free access as far as possible to all sides of the detergent block. Where the detergent blocks are arranged one above the other, the contact faces between the individual blocks are not of course accessible to the dissolving power of the water.

Figure 4:
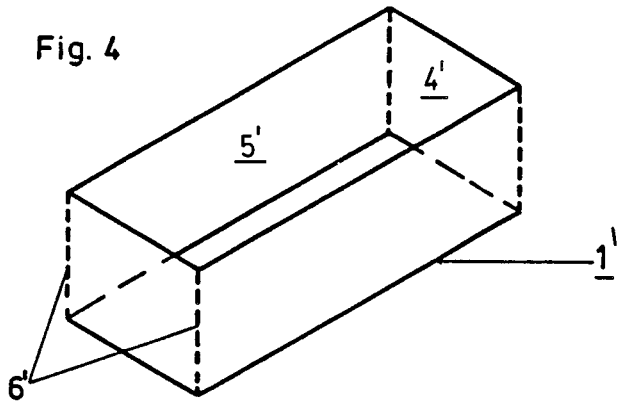
FIG. 4 is a perspective view of an alternate embodiment of the box of FIG. 1, including alternate detergent-releasing means, comprising tear-perforations.

In a particular embodiment of the invention, ejection of the block from the supply pack is facilitated by the presence of at least one tear-open perforation extending substantially perpendicularly to the edge of the open side, such as illustrated in FIG. 4. After one or more perforation(s) encircling a parallelepipedic detergent block on three sides perpendicular to the longitudinal axis thereof has/have been torn open, the supply pack is pulled away or removed from the detergent block, and the exposed block is introduced into the dispenser using an already loosened part of the supply pack.

Figure 9:
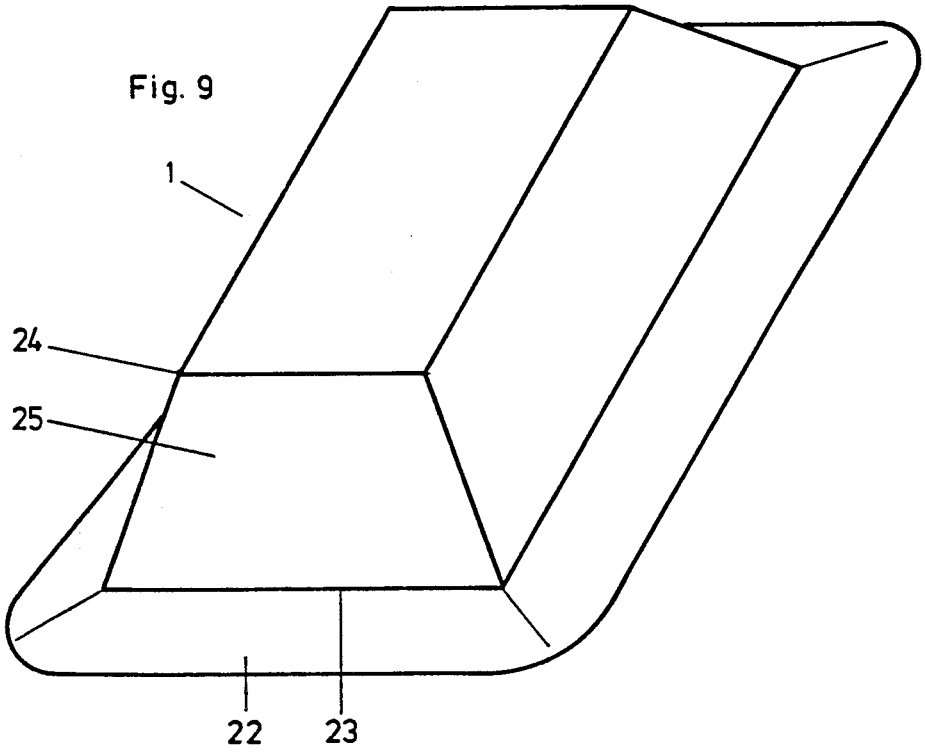
FIG. 9 is an alternate embodiment of the container of FIG. 8, including anti-splash-back rim protective means.

In another embodiment of the invention, the supply pack is in the form of a deep-drawn container, especially a container of a plastic material, such as polyethylene, polyvinyl chloride, polypropylene, or a composite film thereof. The deep-drawn container is also directly usable as a supply pack, but need not be resistant to flushing water or steam inside the dispenser. In this embodiment of the invention, the cross-section of the deep-drawn container advantageously widens conically from its base to the rim of its opening in relation to the normal of the base, as illustrated in FIG. 9. This enables the detergent block to be readily removed from its casting mold on introduction into the dispenser or distributor of the dishwashing machine without having to be touched by hand.

Figure 7:
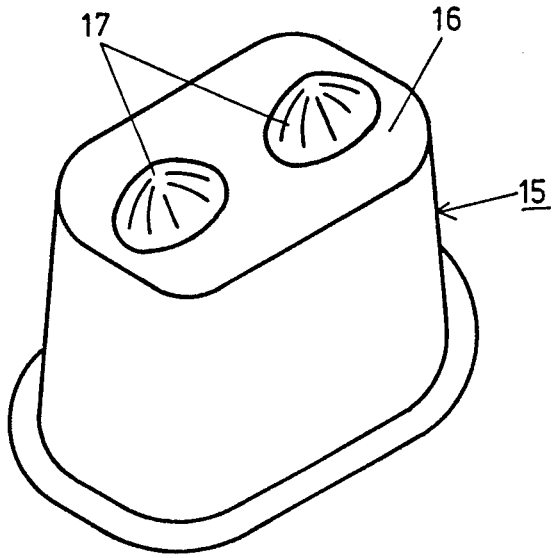
FIG. 7 is a bottom view of a deep drawn container according to the invention including detergent-releasing means comprising flexible recesses disposed in the bottom surface of the container.

In another advantageous embodiment of the invention, the supply pack includes release means for disengaging the block from the supply pack for introduction into the distributor. Illustrative release means are the flexible recesses in the base of the pack as shown in FIG. 7, which permit the block to be loosened by finger pressure on the recess without direct skin contact.

Figure 6:
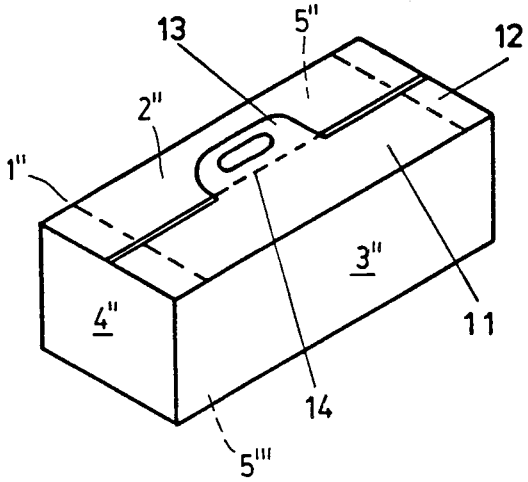
FIG. 6 is an alternate embodiment of the box of FIG. 5, including gripping means for handling the box comprising hinged grip tabs.

In addition, handling of the supply pack is facilitated by gripping means for manipulating the pack such as the hinged grip tabs, as illustrated for another embodiment of the invention shown in FIG. 6. Where the supply pack is in the form of converging flaps, such as a folding box, the grip tabs are conveniently integrally formed on flaps forming a cover element on the supply pack (FIG. 6), or on flaps forming a bottom to the pack. However, the gripping means may also be externally attached to the rim of the opening, particularly where a deep-drawn container is used as the supply pack.

Figure 8:
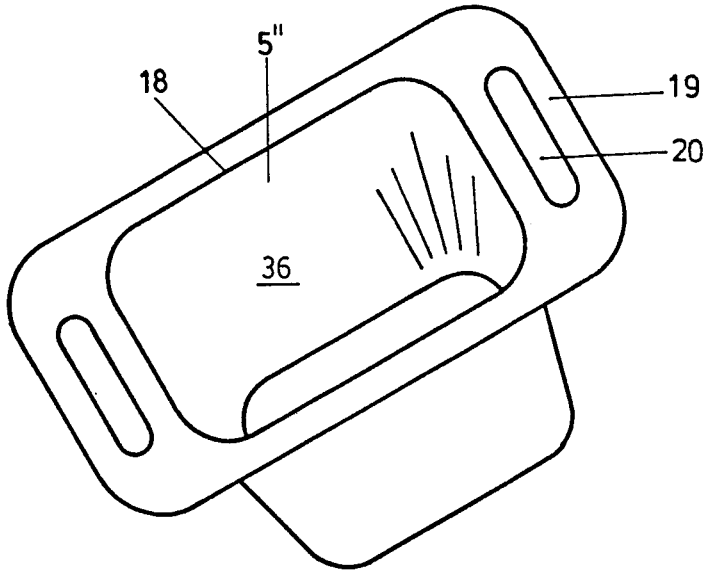
FIG. 8 is an alternate embodiment of the container of FIG. 7, including gripping means for handling the container comprising externally-formed gripping tabs.

In another embodiment of the invention, any residual risk of skin contact through splashing by alkaline detergent solution is avoided if the opening of the retail pack intended for introduction of a detergent block without skin contact includes integrally-formed rimming means for preventing detergent splashback, such as the anti-splash rim lying substantially in the plane of the pack opening and externally encircling the opening, as illustrated in FIG. 8. In a variant of this embodiment, the pack, when it is in the form of a deep-drawn container, is advantageously provided with non-parallel sides which converge on one another substantially frustopyramidally from the opening and which preferably define rounded corners at the junction of the corners, sides and bottom of the pack. The anti-splash rim enables the detergent dispenser to be filled without skin contact and without splashing, even in the presence of possible residual water. Preferably, the rim is advantageousy engageable with support means associated with the distributor such as an inner ledge, for supporting the supply pack during the dispensing step. The external dimensions of the rim are selected so that the rim preferably conforms to and bears tightly against the inner wall of the dispenser, so that on dispensing, as by depressing the bottom of the container, splashback is substantially prevented. Alternatively, for example where the dispenser has no inner ledge, the dimensions of the rim may also be such that the filling side of the dispenser is sealed off during dispensing, i.e. the rim with the container functions as a temporary cover for the distributor. In another modification, the support means includes a peripheral flange in the upper part of the distributor for receiving the anti-splash rim of the supply pack according to this aspect of the invention, the flange may thus function as a bearing surface for the pack during the dispensing operation.

Figure 11:
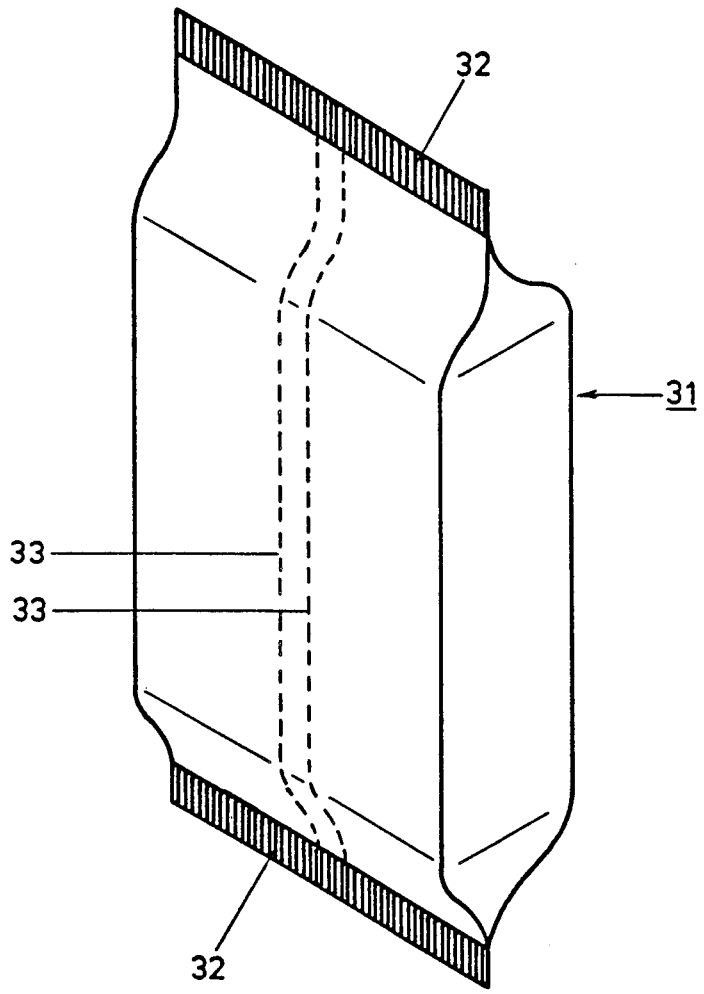
FIG. 11 illustrates a supply pack of film material according to the invention.

In another embodiment of the invention, the supply pack is in the form of a tubular film for molding a detergent produced in molten to plastic form. In this, and other embodiments preferred detergents (a) contain alkali hydroxide, alkali silicates, water (preferably in the form of water of crystallization), and optionally penta-alkali triphosphate and organic complexing agents; (b) are alkali-hydroxide-free detergents containing from 65 to 85% by weight, based on the detergent as a whole, of a mixture of alkali silicates and penta-alkali triphosphates, and homogeneously dispersed active chlorine donors which are preferably organic; or (c) are a homogeneous and storable alkali-hydroxide-containing detergents, further containing alkali silicates and water, preferably in the form of water of crystallization, and optionally penta-alkali triphosphate and, further, active chlorine donors. The detergent selected is solidified according to the invention in the tubular film, which functions as a casting mold for the molten or plastic detergent, to form a detergent block. The tubular film comprises, for example, a monofilm or composite film formed into a endless tube such as a polypropylene film, or a one-ply or multi-ply polyethylene film, or a composite film of polyester and polyethylene, or paper and polyethylene. Preferably, the tube containing the detergent is sectioned into segments of the desired size when the detergent is still pliable, and the segments subsequently delivered to a solidification zone, e.g. a cooling zone for solidification into a solid shaped form. It is particularly important that the film used form a sufficient barrier against ambient water vapor to protect the hygroscopic detergent material during storage and handling. In this embodiment, handling of the supply pack during the filling or refilling of dispensers is facilitated if the tubular film pack has weld seams or is crimp-sealed at its longitudinal ends with at least one tear-open weld seam on its surface, as illustrated in FIG. 11.

In the alkali-hydroxide-containing, chlorine-free detergent containing alkali-silicates, water, preferably in the form of water of crystallization, and optionally penta-alkali triphosphate and, further, organic complexing agents, the organic complexing agent may be, for example, sodium citrate dihydrate, the sodium salt of nitrilotriacetic acid, the sodium salt of ethylenediamine tetraacetic acid, the sodium salt of ethylenediamine tetramethylene tetraphosphonic acid, the sodium salt of diethylenetriamine pentaphosphonic acid, the sodium salt of 1-hydroxyethane-1,1-diphosphonic acid, or the sodium salt of 2-phosphonobutane-1,2,4-tricarboxylic acid. The detergent best contains from 0.1 to 10% by weight, and preferably from 0.5 to 5% by weight, of one or more organic complexing agents based on the weight of the detergent as a whole.

A detergent such as this is prepared, for example, by first heating the alkali silicate as metasilicate hydrate or waterglass solution, either on its own or together with solid alkali hydroxide or its monohydrate, to 45° to 48° C., and allowing the mixture to spontaneously heat to 60° to 65° C. The remaining constituents are subsequently added preferably with water of hydration, with stirring or kneading: the pentasodium triphosphate and/or its hexahydrate and the organic complexing agent are stirred in last at 60° to 70° C. The still liquid melt is then poured into casting molds according to the invention.

In the alkali-hydroxide-free detergent containing from 65 to 85% by weight, based on the weight of the detergent as a whole, of a mixture of alkali silicates and penta-alkali triphosphates, and a homogeneously dispersed addition of preferably organic active chlorine donors, the ratio of pentasodium triphosphate (as alkali phosphate) to sodium metasilicate (as alkali silicate), both anhydrous, is 1:1-2 and preferably 1:1-1.7 with the active chlorine donor being present, for example, in quantities of from 0.2 to 4% by weight and preferably in quantities of from 0.5 to 2% by weight, based on the active chlorine content and the weight of the detergent as a whole.

A detergent such as this is prepared, for example, by heating sodium metasilicate.9 $H_2O$ to 45° to 55° C., adding all the other constituents, optionally containing water of hydration, with stirring or kneading. The pentasodium triphosphate and the active chlorine donors are added last, and then the still liquid melt is poured into casting molds or pack molds according to the invention.

The necessary cooling time for the molten to plastic detergent during which it solidifies need not involve time loss associated with intermediate storage in a separate solidification zone if, as envisaged in another embodiment of the invention, the casting mold (supply pack) is placed with the partially liquid or plastic melt in an outer packaging case and is solidified therein as by cooling, preferably on a shipping pallet.

The outer packaging case may be formed, for example, by the packaging of the supply pack in a shipping box, tray, etc.

The detergent usable according to the invention is thus produced either by an extrusion of fusion process. The supply pack facilitates both molding by preventing splashback in preferred embodiments, and loading of the distributor section of the washing machine. The pack preferably comprises disposable materials which do harm or pollute the environment. Since the container need not withstand mechanical and chemical stresses within the dishwashing machine; at the same time, hazard to the user, both filler and supplier, is reduced. Thus both the pack itself, through the materials employed, and the process of making the pack, which lends itself to a continuous execution, are of improved efficiency of production.

The following description refers to the drawings.

Figure 2:
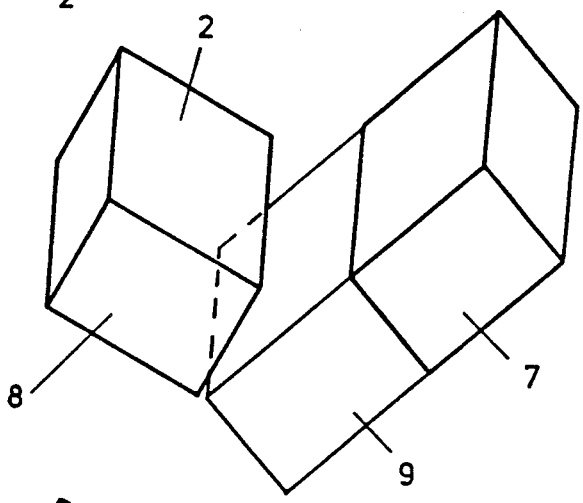
FIG. 2 illustrates the box of FIG. 1 readied for dispensing a shaped solid detergent according to the invention.
Figure 3:
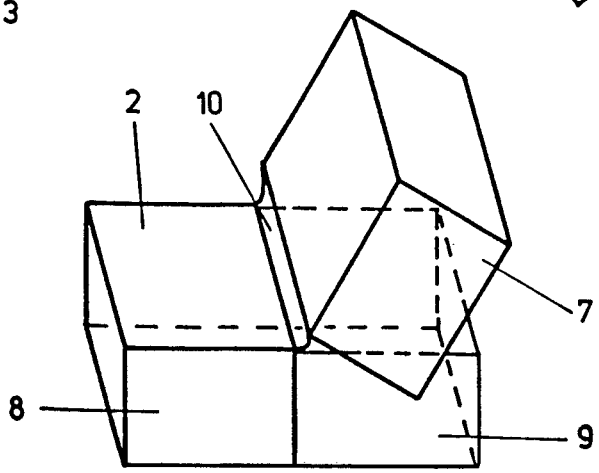
FIG. 3 is a perspective view of an alternate embodiment of the box of FIG. 2, including detergent-releasing means comprising hinged means.

An erected folding box generally denoted by the reference (1) in FIGS. 1 to 3 includes a base (2), longitudinal sides (3) and end faces (4). The erected folding box (1) in FIG. 1 includes an opening (5) on its upper side adapted for the introduction of a moldable detergent material to be cast therein and for the ejection of a fused detergent block after solidification of the detergent. In FIG. 1, the folding box detergent (1) is in the filling position, i.e., in the position in which the moldable molten or plastic detergent material is introduced from above.

To facilitate ejection, the folding box (1) includes release means for promoting disengagement of the detergent solid from the box or pack (1), comprising spaced perforations (6) extending around the midsection of the box, enabling the pack to be torn open so that two box sections (7) and (8) are formed as shown in FIGS. 2 and 3.

In FIG. 2, the performations (6) have been torn fully open to form two box sections (7) and (8) which are separated for pulling away with both bands from the fused block (9). In use, the fused block (9) is positioned over the filling opening of a distributor to be filled (not shown), the box section (8) is removed while the fused block (9) is held by means of the box section (7), and the detergent block (9) is then dispensed from the section (7) into the distributor while the box section (7) is retained in the hand.

FIG. 3 diagrammatically illustrates a folding box (1) in which the section of the perforations (6) situated in the box (2), i.e. parallel spaced base perforations (34) form a hinge 10 for the two box sections (7) and (8). By virtue of the parallel perforation lines (34) of the base perforation, the box sections (7) and (8) are readily folded open from the fused block (9) without sticking. In FIG. 3, the box section (7) is shown unfolded from the fused block (9). The block (9) is thus dispensable into the distributor (not shown) while the box section (8) is retained.

Figure 5:
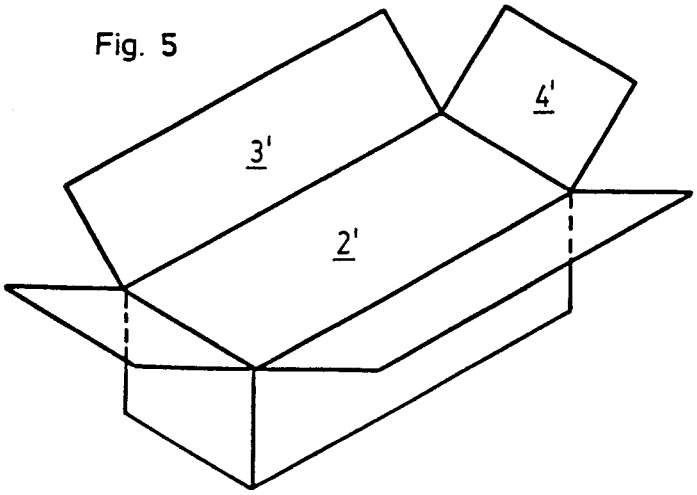
FIG. 5 is a perspective view of an alternate embodiment of the box of FIG. 4, including opened side flaps.

In FIG. 4, a folding box (1') is shown having a plurality of tear-open perforations (6') extending from the base (2') of the folding box to an upper edge thereof, one of the perforations (6') being disposed at each of the four corners of the box 1' to facilitate ejection of a detergent solid. The perforations (6') enable the pack to be torn open so that a flat blank open at the corners is formed as shown in FIG. 5. By holding the longitudinal sides (3') and/or end faces (4') contact with the skin is avoided. The end faces (4') and longitudinal sides (3'), which project sideways, on introduction into the distributor cover the filling opening and thus prevent any splashing of dissolved detergent in the distributor or dispenser onto the skin of the supplier.

FIG. 6 diagrammatically illustrates a folding box (1'') wherein an opening face (5'') is covered by two pair of flaps (11) and (12) hinged to the longitudinal sides (3'') and the end faces (4'') respectively. An integral grip tab (13) for facilitating handling of the box (1'') is flap (11) and is erectible via a crease (14) for convenient holding and carrying. In an alternate embodiment, the flaps (11) and (12) form a base (2'') of the folding box (1) and the box (1') includes an open face (5'') as illustrated in FIG. 1. In this embodiment, the flaps, preferably including tab (13), are situated underneath on introduction of the molten or plastic detergent. Before introduction of the fused block (not shown in this Figure) into the dishwashing machine, the grip tab (13) is erected via the crease (14) so that the folding box (1''), in the position shown in FIG. 6, held by the grip tab (13), permits the fused block to be ejected without contact with the skin.

The folding boxes shown in FIGS. 1 to 6 are preferably made of plastic-backed cardboard material. Suitable plastics are, in particular, polyethylene and polyvinyl chloride. On the one hand, the plastic coating prevents the molten or plastic detergent material from sticking to the back of the box (1) during casting, and on the other hand, it helps the solidified block (9) to slide out of the folding box (1) during the dispensing operation.

FIGS. 7 and 8 diagrammatically illustrate a supply pack in the form of a deep-drawn plastic container (15) open on the top side thereof. The deep-drawn container in FIG. 7 includes two flexible internally depressible recesses (17) in the base (16) to make it easier, when the retail pack is in the filling position above the dispenser of a diswashing machine, as shown, to disengage and release a contained detergent block (not shown) from the deep-drawn container (15) by manipulation, as by pressing with the thumbs or fingers. The recesses (17)

shown in FIG. 7 may of course also be provided in the base (2) of a folding box (1) as shown in FIGS. 1 to 6.

FIG. 8 diagrammatically illustrates a deep-drawn container (15) of plastic, similar to the supply pack in FIG. 7, wherein a rim (18) surrounding an open side (5″) is formed with grip tabs (19) and grip openings 20 to facilitate ejection of a contained fused detergent block (not shown) by enabling the bottom of the deep-drawn container (15) to be pressed firmly with both thumbs during the dispensing operation. The flexibility of the plastic used, for example polyethylene, polyvinyl chloride or polypropylene, depending on the wall thickness and design-related conicity of the deep-drawn container, is also of importance to the ejection of the fused detergent block, and is adapted for ready dispensing.

Figure 10:
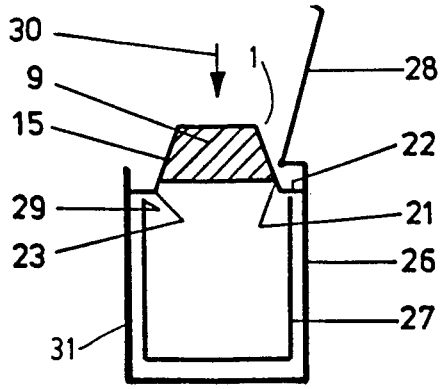
FIG. 10 is a cross-sectional view of the container of FIG. 9 illustrating a solid detergent shape according to the invention in the process of being dispensed from its container.

FIG. 9 illustrates a supply pack generally indicated at (1), preferably in the form of a deep-down container with sloping sides (25), similar to FIG. 7, around whose ejection opening (21) as shown in FIG. 10 an anti-splash rim (22) extends in the plane of the opening (21). The rim (22) is formed integrally with the edge (23) of the opening (21). Emptying of the detergent block pack shown in FIG. 9 is facilitated if the corners (24), at which the substantially frustopyramidally converging side faces (25) abut one another, are rounded off, as illustrated at (36) in FIG. 8.

FIG. 10 is a cross-section of the supply pack (1) of FIG. 9 ready for use in a washing machine distributor diagrammatically indicated at (37). The distributor (37) includes a container (26) having a sieve insert (27) and an optional cover (28). The supply pack (1) is emptied out through the sieve insert (27). For example, a supply pack (1) according to FIG. 9 is placed upside down onto a ledge (29) of the sieve insert (27) so that a detergent block (9) in the pack (1) drops into the sieve insert (27) in the direction of the arrow (30). In this connection, the anti-splash rim (22) of the pack (1) functions both as a cover to prevent detergent solution from splashing back out of the distributor container (26) onto the supplier, and as a bearing surface during introduction of the supply pack into the distributor (37).

Although not shown in detail, the supply pack containers which are open on one or more sides are desirably individually wrapped in moisture-proof protective film or are packed several at a time in a relatively large shipping box which affords appropriate protection to the hygroscopic detergent packed therein against moisture.

FIG. 11 illustrates supply pack (31) formed from film material. The material was formed in the shape of an endless tube in which a molten or plastic detergent material was introduced, the tube was segmented and the detergent solidified therein. The supply pack (31) includes crimped seals (32) at each end thereof, and a tear-open weld seam (33) on one side. In an alternate embodiment, the detergent is first cooled and allowed to solidify, and subsequently divided into portions of the required size and packed in a suitable film wrapper.

We claim:

1. A detergent supply pack for supplying a shaped detergent solid to a detergent distributor associated with a dishwashing apparatus comprising a container for said detergent solid which container is a deep-drawn container of a semi-rigid plastic material including at least one open side and a base opposite said open side, a shaped detergent solid cast-molded therein, dispensing means for dispensing the detergent solid from the container into the distributor, and release means for promoting release of the detergent solid from the container which release means comprise at least one internally depressible recess in said base, wherein said container simultaneously functions as a mold for the cast-molded detergent, as a container for the detergent solid during shipping and storage thereof, and as handling means for handling the detergent and introducing the detergent into the washing apparatus distributor so that skin contact between a handler and the detergent is avoidable.

2. The supply pack of claim 1, further including protective means for protecting the handler from detergent back splash.

3. The supply pack of claim 1, further including gripping means for facilitating handling of the supply pack.

4. The supply pack of claim 2, further including gripping means for facilitating handling of the supply pack.

5. The supply pack of claim 1, wherein the container comprises a parallelpipedic box having one open side and a base opposite said open side, wherein the release means comprises at least one tear-open perforation extending substantially perpendicularly from an edge of said box defining said open side.

6. The supply pack of claim 5, wherein the release means comprises at least one perforation extending around the mid-section of the box from a first box edge defining said open side to a second box edge defining said open side parallel to said first edge.

7. The supply-pack of claim 6, wherein the perforation is a tear-open perforation.

8. The supply pack of claim 6, wherein said perforation comprises two tear-open perforation sections and a fold-open perforation section comprising a pair of spaced fold-open perforations extending across the base of the box which functions as a hinge for the end sections of the box when the tear-open sections are torn open.

9. The supply pack of claim 5, wherein the tear-open perforation extends along four corners of the box substantially to intersect the base thereof.

10. The supply pack of claim 4, wherein the container comprises a rectangular box having one open or openable side and a base opposite said open or openable side, and said gripping means comprises a hinged grip tab disposed on the base of the box or on said openable side.

11. The supply pack of claim 1, further including side walls, which slope toward said base.

12. The supply pack of claim 11, wherein the side walls and base of the container define a frustropyramid and the interior corners are rounded at the juncture of the side walls and base.

13. The supply pack of claim 1, further including protective means for protecting a handler from detergent splash-back comprising a rim disposed around the edge of the container defining said open side.

14. The supply pack of claim 13, wherein the rim is adapted to function further as a bearing surface during dispensing of said detergent into said distributor.

15. The supply pack of claim 13, further including gripping means comprising gripping tabs integral with said rim.

16. The supply pack of claim 1, wherein the plastic material comprises polyethylene, polyvinyl chloride, polypropylene, or a composite thereof.

17. The supply pack of claim 1, wherein the container comprises a tubular film.

18. The supply pack of claim 17, wherein said detergent comprises (a) an alkali-hydroxide-containing detergent including alkali silicates; water; optionally penta-alkali triphosphate present in a phosphate:silicate ratio of 1:1–2; and at least one organic complexing agent present in 0.1–10.0 wt %; or (b) an alkali-hydroxide-free detergent including from 65 to 85% by weight, based on the weight of the detergent as a whole, of a mixture of alkali silicates and penta-alkali triphosphates present in a phosphate:silicate ratio of 1:1–2 and at least one of a homogeneously dispersed active chlorine donor present in 0.2–4.0% by weight based on the chlorine active weight and the total detergent weight; or (c) a homogeneous and storable alkali-hydroxide-containing detergent including alkali silicates; water; optionally penta-alkali triphosphate present in a phosphate:silicate ratio of 1:1–2; and at least one active chlorine donor present in 0.2–4.0% by weight based on the chlorine active weight and total detergent weight;

which is cast-molded from a plastic-to-molten state.

19. The supply pack of claim 17, wherein the container comprises a tubular film wherein the opposite open ends thereof are crimp-sealed, and said release means comprises a tear-opened weld seam extending between the crimp-sealed ends.

20. The supply pack of claim 1, wherein the detergent is cast-molded from a detergent melt to form a fused, shaped detergent solid.

21. The supply pack of claim 1, wherein the container material is cardboard, plastic-laminated cardboard, or plastic-impregnated cardboard.

22. A process for the production of the detergent supply pack of claim 1, comprising producing a detergent in a cast-moldable physical state, introducing the detergent into said container, and solidifying the detergent.

23. The process of claim 22, wherein said container is a parallelipiped box having one open or openable side and a base opposite said side, and said release means comprises at least one tear-open perforation extending perpendicularly from an edge defining said open or openable side.

24. The process of claim 22, wherein said container is a tubular film crimp-sealed at the opposite open ends thereof and said release means comprises a tear-open perforation extending between said crimp-sealed ends.

* * * * *

UNITED STATES PATENT AND TRADEMARK OFFICE

CERTIFICATE OF CORRECTION

PATENT NO. : 4,774,014

DATED : September 27, 1988

INVENTOR(S) : Kuenzel et al.

It is certified that error appears in the above-identified patent and that said Letters Patent is hereby corrected as shown below:

At the title page item [30] after the second line enter the following:

May 14, 1986 [DE] Fed. Rep. of Germany 8613091

Signed and Sealed this

Twenty-eighth Day of March, 1989

*Attest:*

DONALD J. QUIGG

*Attesting Officer*

*Commissioner of Patents and Trademarks*